US011833438B2

(12) United States Patent
Dong

(10) Patent No.: US 11,833,438 B2
(45) Date of Patent: Dec. 5, 2023

(54) AXE THROWING GAME WITH AUTOMATED SCORING AND AXE RETURN

(71) Applicant: GUANGZHOU BAISHUN ANIMATION TECHNOLOGY CO., Guangzhou (CN)

(72) Inventor: Chaowen Dong, Guangdong Province (CN)

(73) Assignee: GUANGZHOU BAISHUN ANIMATION TECHNOLOGY CO., Guangzhou (CN)

( * ) Notice: Subject to any disclaimer, the term of this patent is extended or adjusted under 35 U.S.C. 154(b) by 306 days.

(21) Appl. No.: 17/199,675

(22) Filed: Mar. 12, 2021

(65) Prior Publication Data

US 2022/0168630 A1 Jun. 2, 2022

(51) Int. Cl.
*A63F 9/02* (2006.01)

(52) U.S. Cl.
CPC ..... *A63F 9/0208* (2013.01); *A63F 2300/61* (2013.01)

(58) Field of Classification Search
CPC ..... A63F 9/0204; A63F 9/0208; A63F 2009/0021; A63F 2009/0026
USPC ..... 273/348, 371, 378, 394, 395, 396, 397, 273/404, 408
See application file for complete search history.

(56) References Cited

U.S. PATENT DOCUMENTS 2,064,310 A * 12/1936 Marker ..... G07F 17/38 273/142 JA
2,734,745 A * 2/1956 Tarte ..... A63B 63/06 273/368
3,401,937 A * 9/1968 Rockwood ..... F41J 3/0004 250/222.2
3,510,133 A * 5/1970 Gretzky ..... F41J 5/02 273/404
3,623,065 A 11/1971 Rockwood et al.
3,790,173 A 2/1974 Callaway
4,824,120 A 4/1989 Wang
(Continued)

FOREIGN PATENT DOCUMENTS

DE 2702502 A1 7/1978

OTHER PUBLICATIONS

Search Report for EP Application No. 21211737.8 dated Apr. 11, 2022.

*Primary Examiner* — Joseph B Baldori
(74) *Attorney, Agent, or Firm* — Andrus Intellectual Property Law, LLP

(57) ABSTRACT

An amusement game that includes a target assembly that functions to receive an axe-shaped game piece. The amusement game includes a target assembly having one or more target areas that each include a series of spaced fingers designed to receive and retain the game piece when the game piece is thrown at the target area. After the game piece or pieces have been thrown, a sensor frame having a series of sensors detects the location of the game piece and a point total is assigned to the sensed location. A drive motor moves a release frame relative to the targets to release the game piece from the target. The release frame includes a wire mesh extending across an open area such that the wire mesh moves along the spaced fingers to release the game piece. A return conveyor receives the released game piece and automatically returns the game piece to the player.

15 Claims, 12 Drawing Sheets

(56) References Cited

U.S. PATENT DOCUMENTS

| | | | | |
|---|---|---|---|---|
| 5,328,190 | A * | 7/1994 | Dart | A63F 13/213<br>273/358 |
| 5,649,706 | A * | 7/1997 | Treat, Jr. | F41J 9/14<br>463/52 |
| 10,724,832 | B2 * | 7/2020 | Washington | F41J 3/00 |
| 11,397,071 | B1 * | 7/2022 | Maslinkovskiy | F41J 5/02 |
| 2020/0038743 | A1 | 2/2020 | Chung | |

* cited by examiner

AXE THROWING GAME WITH AUTOMATED SCORING AND AXE RETURN

CROSS REFERENCE TO RELATED APPLICATION

The present application is based on and claims priority to Chinese Utility Model Application 202022842626.0 filed Dec. 2, 2020.

BACKGROUND

The present disclosure generally relates to game devices, in particular a target-based throwing game. More specifically, the present disclosure relates to an axe throwing game that includes a target and automatically scores each thrown axe based on the target and returns the axe to the player for the next turn.

Recently, axe throwing games and locations have become increasingly popular. In such games, two teams that each include one or more players take turns throwing axes having metal heads and wood handles at a target that is located a pre-determined distance from the players. Once all of the axes have been thrown, the player or players walk to the target to score the axes based on their location on the target. The players retrieve the axes for the next round of play and return to the designated throwing area.

Such games utilize wooden targets and metal axe heads, which are both heavy and dangerous. Further, these games require the player to manually score the game and retrieve the thrown axes after each round, which further complicates the game play and decreases the overall enjoyment of the game.

It is an object of the present disclosure to provide an amusement game that replicates an axe throwing game while providing for automatic scoring, automatic return of the axes and a more user friendly axe-shaped game piece.

SUMMARY

The present disclosure relates to an amusement game that emulates an axe throwing game. More specifically, the present disclosure relates to an amusement game that automatically scores one or more axe-shaped game pieces that are received on one or more targets and returns the game pieces to the player after scoring.

The amusement game of the present disclosure includes one or more axe-shaped game pieces that are thrown by a player or players toward at least one target that is positioned a playing distance from the player or players. Each target is designed to includes a plurality of spaced fingers that are flexible and spaced from each other to receive and retain the game piece when the game piece is thrown into contact with the target.

The amusement game includes a release frame that is mounted to move relative to the one or more targets between a retracted playing position and an extended release position. During such movement, the release frame releases the game piece from the target. A return conveyor is positioned below the targets to receive the game piece when the game piece is removed from the target. The return conveyor is operable to move a conveyor belt in a direction to return the game piece to the player without requiring the player to actively retrieve the game piece from the targets.

In one contemplated embodiment, the amusement game includes a plurality of sensors that are positioned relative to the targets such that the sensors can detect the position of a game piece when the game piece is retained on the target. In one embodiment, the sensors can be an infrared sensor array that includes both light emitters and light detectors positioned on a sensor frame.

The amusement game of the present disclosure includes one or more targets that each include a plurality of nylon fingers that extend outward in a spaced relationship that are designed to receive and retain the axe-shaped game piece in a stable and reliable manner. The target assembly further includes an infrared sensor detection frame that is positioned around the outer periphery of the target plate to accurately detect a game piece when the game piece is received on one of the target areas. The detection of the game piece by the sensor frame thus improves the accuracy of the game results by automatically scoring the location of the game piece relative to the target. The amusement game further includes an axe recovery component that allows the game piece to be automatically retrieved after the game has finished or after a round of the game has finished without the need for manual retrieval. The axe recovery component includes a return conveyor that receives one of the game pieces and returns the game piece to the player.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
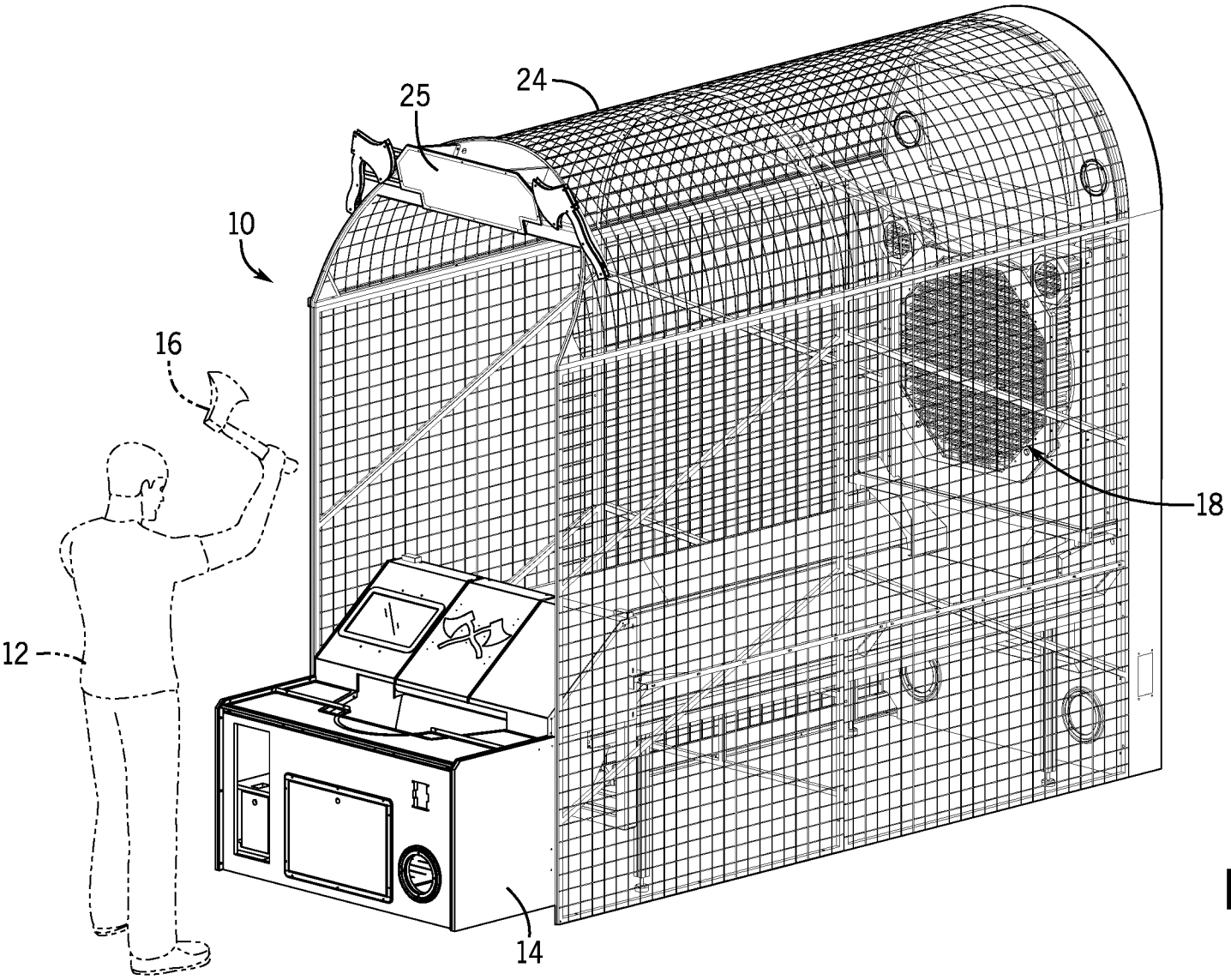
FIG. 1 is a perspective view of the amusement game of the present disclosure showing a player about to engage in game play.

FIG. 1 illustrates an amusement game 10 constructed in accordance with the present disclosure. In the embodiment shown in FIG. 1, a player 12 is shown positioned within a designated throwing area that is a pre-determined distance from a front game cabinet 14 and throwing a game piece 16 toward a target 18 that is located a selected distance from the front game cabinet 14. In the embodiment illustrated in FIGS. 1 and 2, the game piece 16 has the shape and configuration of an axe that includes both an axe head 20 and an axe handle 22. Although the embodiment shown in the drawing figures contemplates use of an axe-shaped game piece 16, it should be understood that other configurations for the game piece could be utilized while operating within the scope of the present disclosure. In the embodiment shown in FIG. 1, a protective cage 24 is positioned between the front game cabinet 14 and the target 18 to define a throwing lane that is designed to contain the axe as the axe is thrown by the player 12 toward the target 18. The cage 24 can be formed from a variety of different materials, such as a wire mesh or a nylon mesh. A game banner 25 is shown at the front of the cage 24 to provide a place for the game name and other information to the player 12.

Figure 2:
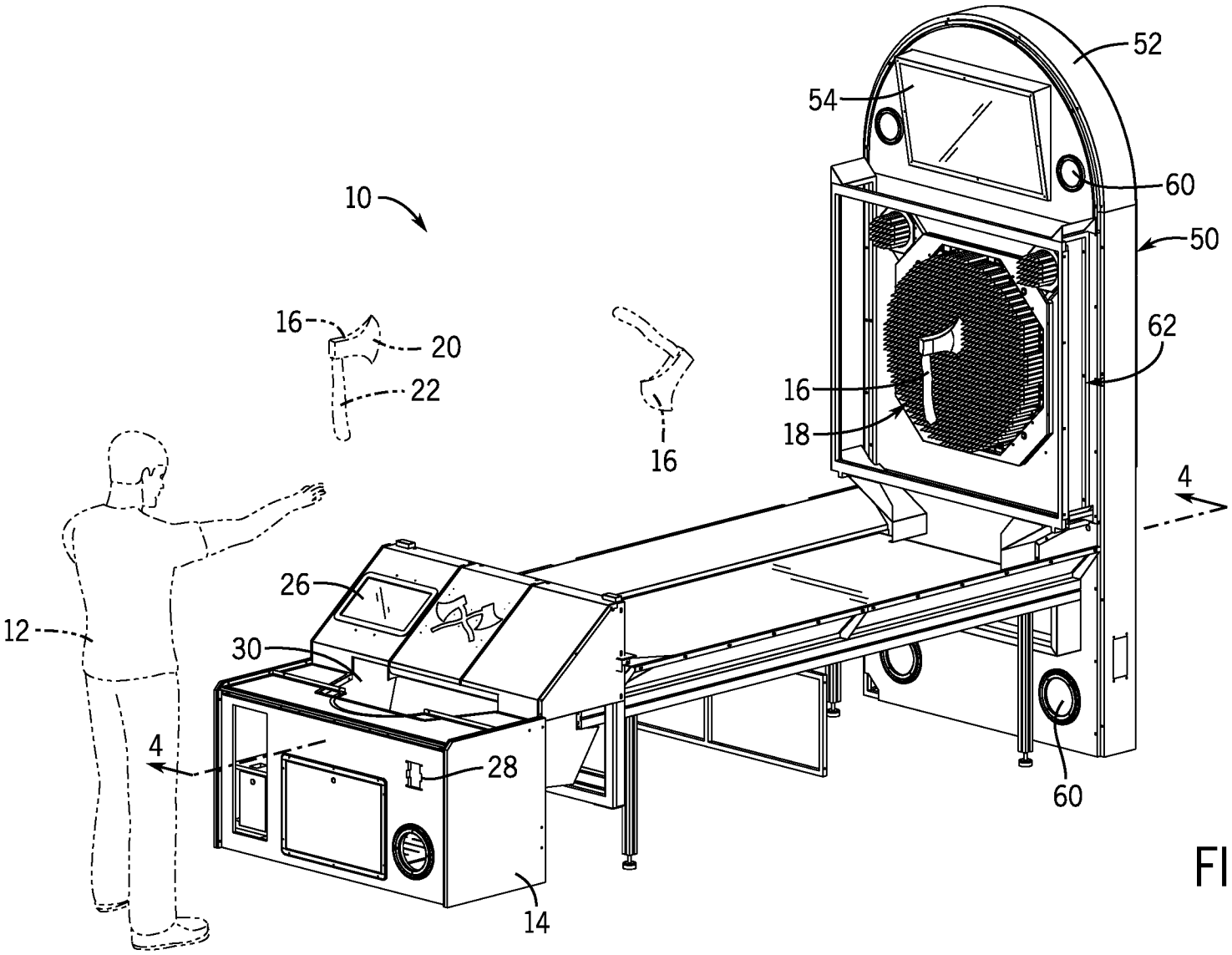
FIG. 2 is a perspective view similar to FIG. 1 with the protective enclosure removed and one of the game pieces received on the target.

FIG. 2 illustrates the amusement game 10 with the cage 24 removed to further illustrate the operating components of the amusement game 10. As shown in FIG. 2, the front game cabinet 14 includes a display screen 26 that provides instructions to the player 12 during the game play and before the game play has started. Such information could include the number of players, the cost per player, the game name and other information about scoring as the game play progresses. In the currently contemplated embodiment, the game 10 supports up to six players in any one game. However, the game could be played with more or fewer players as desired. The front game cabinet 14 further includes a ticket dispenser 28 or other type of mechanism to award the player 12 with credits or tokens depending upon the success of the player.

Figure 3:
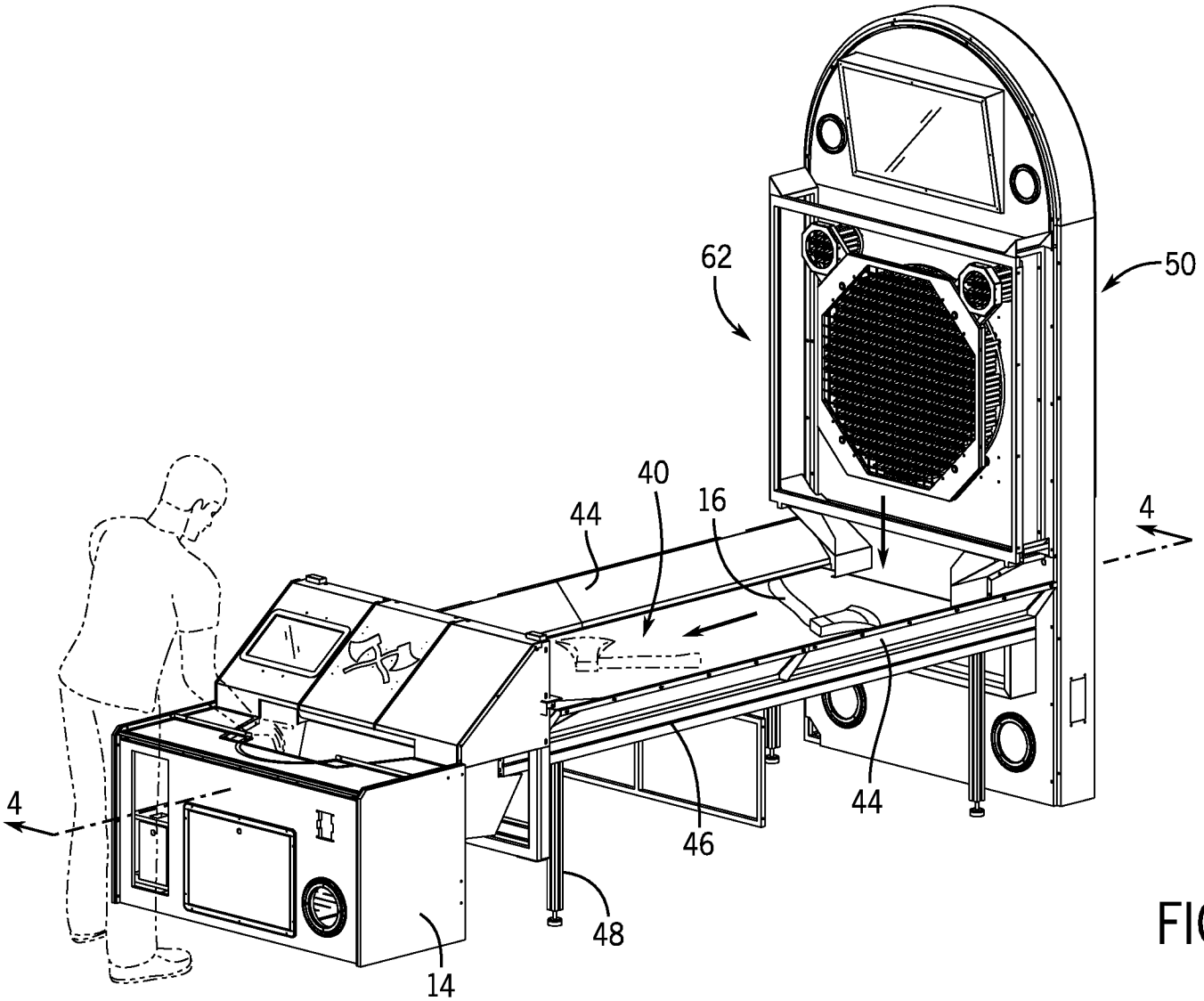
FIG. 3 is a perspective view showing the return of one of the game pieces after the automated removal of the game piece from the target.
Figure 4:
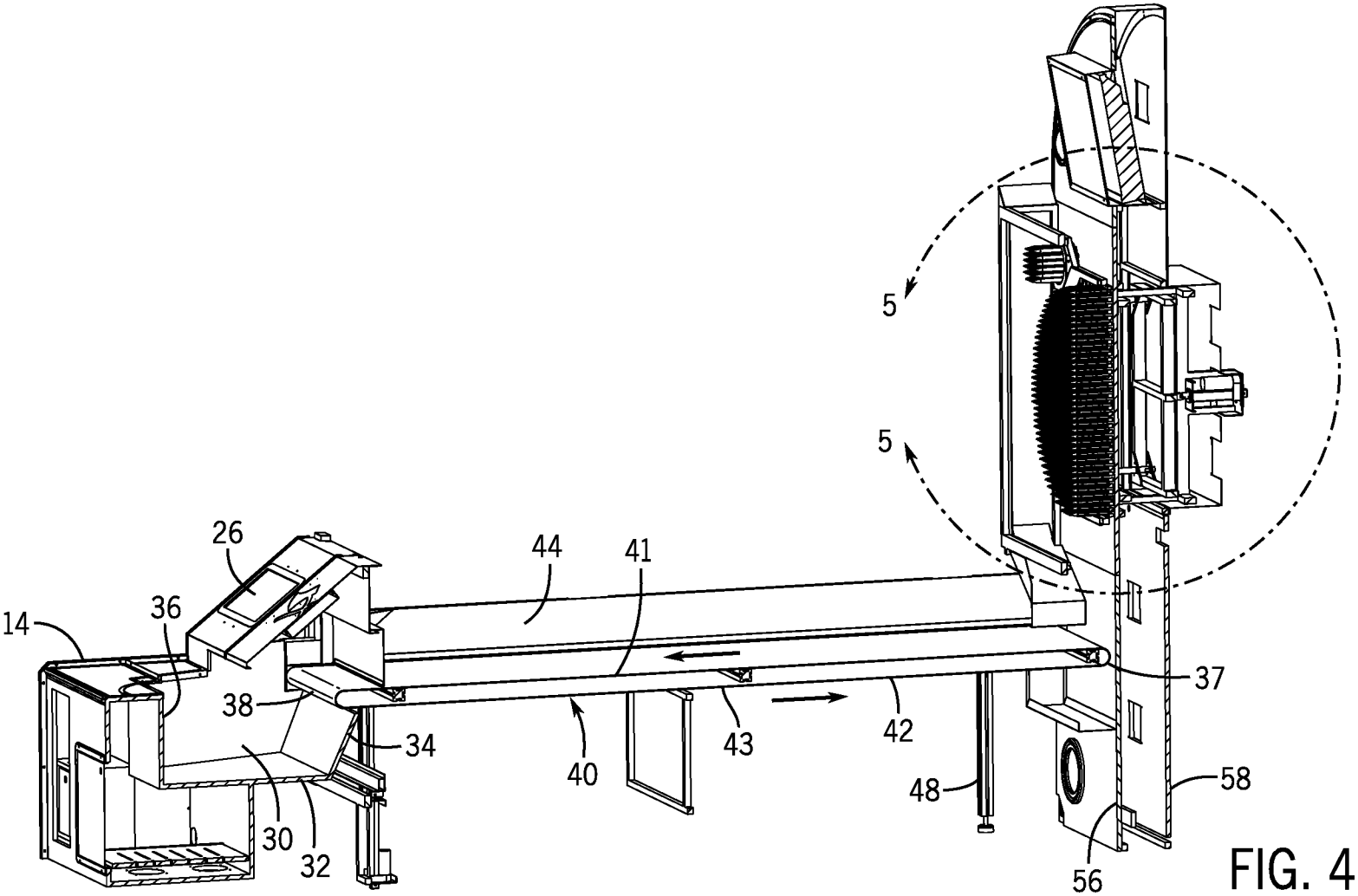
FIG. 4 is a section view of the amusement game taken along line 4-4 of FIG. 3.

The front game cabinet 14 further defines a recessed access area 30 that allows the player 12 to retrieve one of the game pieces 16 after the game piece has been automatically returned to the player. The access area 30 is best seen in FIG. 4 and is formed as a recessed well created by a bottom wall 32, a sloped front wall 34 and a back wall 36. The sloping front wall 34 is positioned below and slightly inward from a second end 38 of a return conveyor 40 that has an endless conveyor belt 42 extending between a first end 37 and the second end 38 of the return conveyor 40. The return conveyor 40 is driven by a drive motor that causes the top run 41 of the conveyor belt to move from the first end 37 to the second end 38 while the bottom run 43 moves in the return, opposite direction. The drive motor (not shown) of the return conveyor 40 is a conventional electric motor that is selectively operated by a control unit of the amusement game to cause the movement of the conveyor belt to return a game piece 16 to the player as illustrated in FIG. 3. As can be seen in FIGS. 3 and 4, a pair of sloped side walls 44 are positioned on opposite sides of the conveyor belt 42 to help direct the game pieces 16 onto the conveyor belt 42 when the game pieces 16 are released from the target in a manner as will be described in much greater detail below. The sloped side walls 44 could include LED lights to further enhance the appearance of the amusement game. Each of the side walls 44 generally extend from the first end 37 to the second end 38 of the return conveyor 40. As can be seen in FIG. 3, the return conveyor 40 is supported by a conveyor frame 46 that includes a plurality of support legs 48.

As can be understood in FIGS. 2 and 3, the target 18 is generally mounted to a rear cabinet 50. The rear cabinet 50 is spaced a desired distance from the front cabinet 14 to define the desired throwing distance for the game pieces 16. The rear cabinet 50 includes a curved top edge 52 that surrounds a display screen 54 that provides instructions to the player 12 as well as scoring during the game play. As shown in FIG. 4, the rear cabinet 50 is formed from a front panel 56 and a rear panel 58. The front panel 56 is secured to the conveyor frame 46 such that the entire rear cabinet 50 is stable during game play. In the embodiment shown in FIGS. 2 and 3, a plurality of speakers 60 are mounted to the rear cabinet 50 to enhance game play.

As can be understood in FIGS. 2 and 3, the rear cabinet 50 provides support for the target assembly 62, which is the primary operating component of the amusement game 10 of the present disclosure. The target assembly 62 is designed to provide a target for the player 12 when throwing the axe-shaped game piece 16. As can be seen in FIG. 2, the target assembly 62 is designed as a target 18 that receives and retains the axe-shaped game piece 16 and automatically scores points for the player 12 based upon the location of the axe-shaped game piece 16 relative to one or more target areas formed on the target assembly. After the location of the axe-shaped game piece 16 has been scored, the target assembly 62 is automatically operated to release the game piece from the target such that the game piece falls onto the top run of the return conveyor 40 as shown in FIG. 3. The drive motor of the return conveyor 40 is then operated to move the game piece 16 from the first end of the conveyor to the second end of the conveyor where it can be retrieved by the player within the access area 30. The details of the operation of the target assembly 62 for receiving, retaining and finally removing the game piece 16 from the target assembly 62 will be described in much greater detail below.

Figure 12:
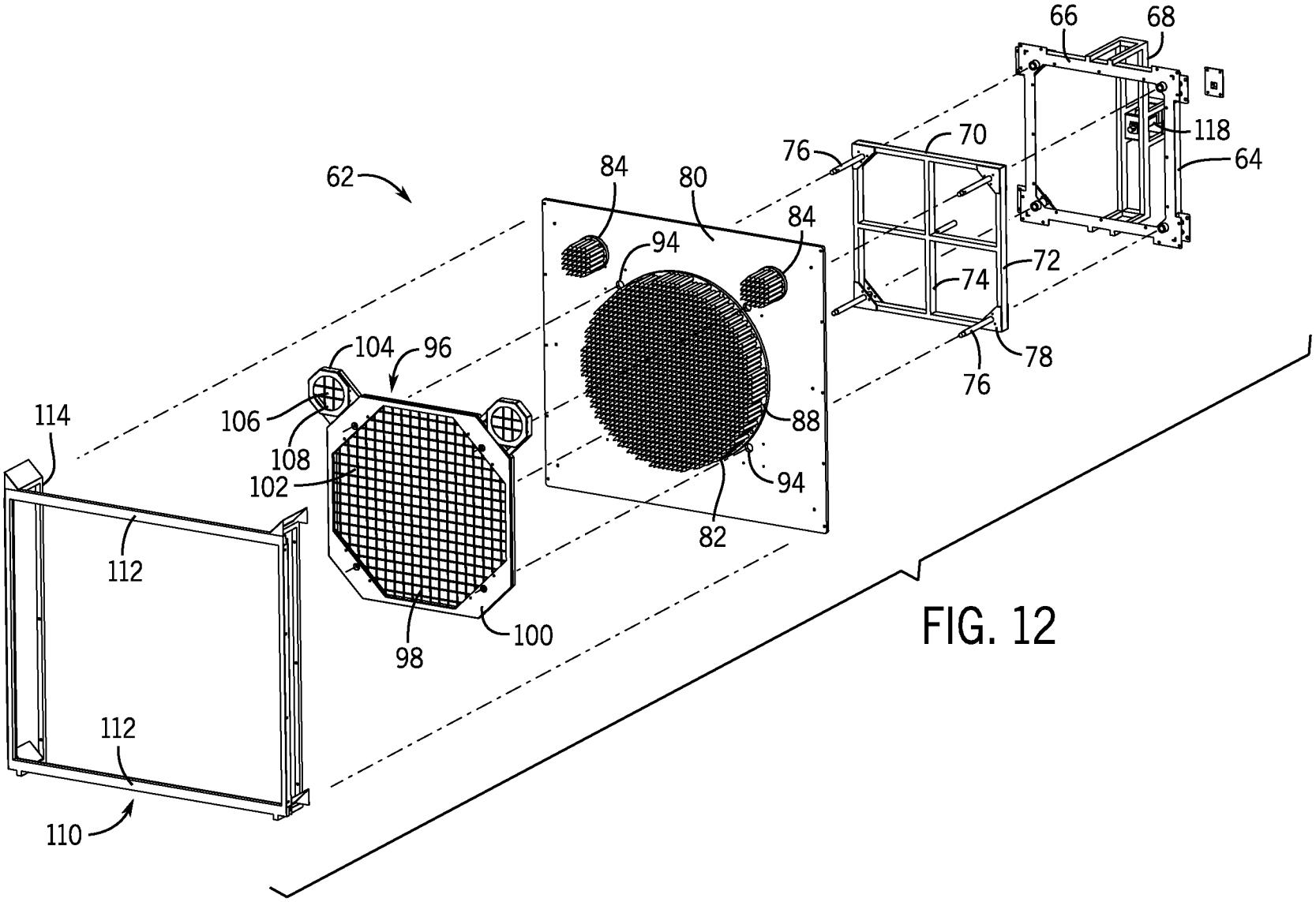
FIG. 12 is an exploded view of the target assembly shown in FIG. 8.

FIG. 12 illustrates the components that form the target assembly 62. The components shown in FIG. 12 are shown in an exploded condition to facilitate understanding of the target assembly 62. The target assembly 62 generally includes a fixed mounting bracket 64 that includes an outer frame 66 and a motor mounting frame 68 that is used to securely position a drive motor 118. The mounting bracket 64 is designed to be securely held in place on the rear panel of the rear cabinet and does not move during operation of the amusement game.

The drive motor 118 is operatively coupled to a movement frame 70 such that operation of the drive motor 118 moves the entire movement frame 70. The movement frame 70 includes a series of side rails 72 that are joined to each other and supported by a series of cross supports 74 to define a generally open frame. The side rails 72 and cross supports 74 define and provide adequate support for four corners of the movement frame 70. Each of the four corners include a connecting rod 76 that extends away from the movement frame 70. The connecting rods 76 are each supported by a pair of corner plates 78 to provide additional structural stability for the connecting rod 76.

As will be described in greater detail below, the movement frame 70 is generally movable toward and away from a target plate 80. The target plate 80 is designed to be stationary and includes one or more target areas. In the embodiment shown in FIG. 12, the target plate 80 includes a primary target 82 and a pair of secondary targets 84. Both the primary target 82 and the secondary targets 84 are constructed generally in the same manner. The secondary targets 84 are designed to have a smaller size than the primary target 80. The secondary targets 84 are assigned a larger point value such that when a game piece hits one of the secondary targets 84, the player is awarded a larger score than when the game piece hits the primary target 82. Although both secondary targets 84 have the same size in the illustrated embodiment, the secondary targets 84 could have different sizes, different point values and different locations on the target plate 80. In addition, it is contemplated that the secondary targets 84 could be eliminated and only the primary target 82 would be present on the target plate 80.

Figure 5:
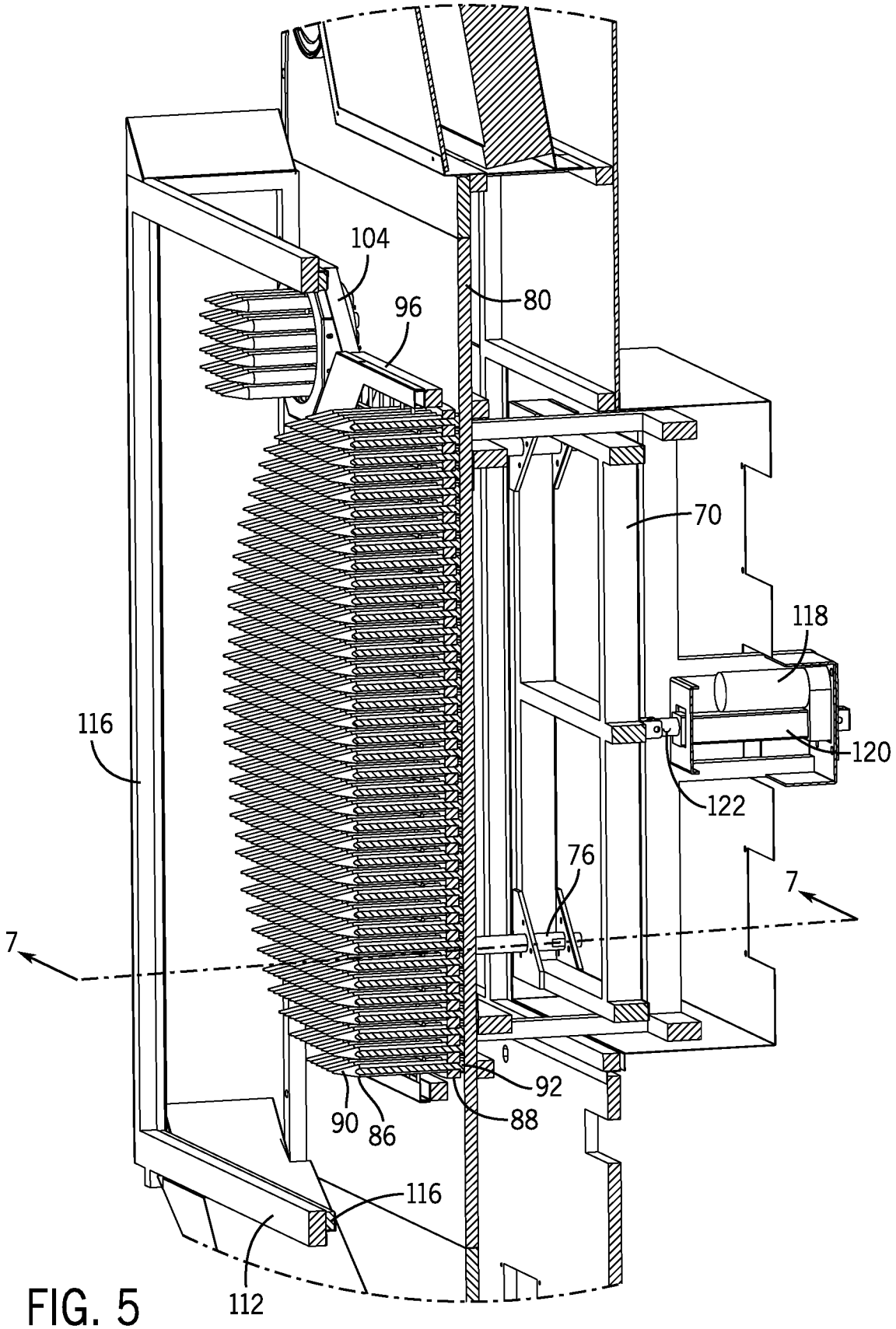
FIG. 5 is a magnified, section view taken along line 5-5 of FIG. 4 with the release frame in the retracted, playing position.

As can be seen in FIG. 5, both the primary target 82 and the secondary targets 84 are constructed from a plurality of spaced fingers 86 that extend away from a finger plate 88. Each of the fingers 86 includes a pointed outer end 90 and a flat inner end 92 that engages with the finger plate 88. In the embodiment illustrated, each of the fingers 86 is formed from either a flexible nylon material or a nylon coating over a metal base. However, other materials are contemplated as being within the scope of the present disclosure. The individual fingers 86 are spaced from each other and mounted to the finger plate 88 in such a manner that the individual fingers 86 can flex a limited amount relative to adjacent fingers. In this manner, the plurality of fingers 86 are able to receive and retain one of the game pieces 16 on the target when the game piece 16 is thrown into the target area, as best shown in FIG. 2. The game piece 16 is retained on the target by the flexible fingers 86 until the target assembly is operated to release the game piece after scoring.

Referring back to FIG. 12, the target plate 80 includes four access openings 94 spaced from the outer periphery of the primary target 82. The access openings 94 are arranged and sized such that each access opening 94 receives one of the connecting rods 76. In this manner, the connecting rods 76 are able to extend through the fixed target plate 80. Thus, the entire movement frame 70 is able to move toward and away from the fixed target plate 80 during game play.

The target assembly 62 further includes a release frame 96 that is designed to be securely mounted to the connecting rods 76 of the movement frame 70. The release frame 96 includes a center release area 98 surrounded by an outer frame 100. The center release area 98 includes a wire mesh 102 laid out in a grid pattern having an open space located between intersecting wires as illustrated. The wire mesh 102 extends across the entire center release area 98 between the edges of the outer frame 100. In the embodiment illustrated in FIG. 12, the center release area 98 has the shape of an octagon that is sized to be slightly larger than the size of the circular primary target area 82. Although the center release area 98 has an octagon shape, other shapes that are slightly larger than the circular primary target area 82 are contemplated.

In addition to the center area 98, the release frame 96 includes a pair of secondary frames 104 that each also include a center release area 106. The center release area 106 of each secondary frame 104 includes a similar wire mesh 108. The center release area 106 of each of the secondary frames 104 has an octagon shape and is sized to surround one of the two secondary targets 84. Again, although the center release area 106 is shown having an octagon shape, other shapes are contemplated. Although the release frame 96 includes wire mesh 102, it is contemplated that the mesh could be formed from other materials, such as durable nylon filaments, plastic filaments or other similar material. The spacing between the wires or filaments of the wire mesh 102 is designed to allow a plurality of the individual fingers 86 to extend through each opening formed in the mesh, as is illustrated in FIG. 5.

Referring back to FIG. 12, the final component of the target assembly 62 is a sensor frame 110. The sensor frame 110 is designed to be stationary and to have a size that is slightly larger than the size of the target plate 80. As illustrated in FIG. 12, the sensor frame 110 includes individual frame elements 112 that are joined to each other to define the generally square shape of the sensor frame 110. The frame elements 112 are also connected to a pair of side frames 114 that provide additional stability for the sensor frame 110. The sensor frame 110 is designed to support a plurality of sensors or sensor bars that are positioned to create a sensing array that surrounds the primary target 82 and secondary targets 84. As shown in FIG. 5, the sensor elements are contained within individual sensor bars 116 mounted along an inner surface of the side frame elements 112. In the preferred embodiment of the present disclosure, the sensor bars 116 include a series of infrared sensors and detectors that are designed to project infrared signals across the front surface of the primary target 82 and the secondary targets 84 and to receive the projected light to sense the presence of the axe-shaped game piece during game play. The individual sensor bars 116 include light emitters and receivers that return signals to a control unit that is able to determine the precise location of one of the game pieces on the targets and assign an appropriate point total. For example, if the game piece is received within the primary target area 82, a first point total is assigned. Likewise, if the game piece is received within one of the two secondary targets 84, a second, higher point total is assigned since the size of the secondary targets 84 is much less than the size of the primary target 82. In addition, the primary target 82 can be colored to provide a variety of scoring zones or areas, such as to replicate the bullseye in a target. Each of the scoring areas can then be assigned different point totals as desired.

Figure 6:
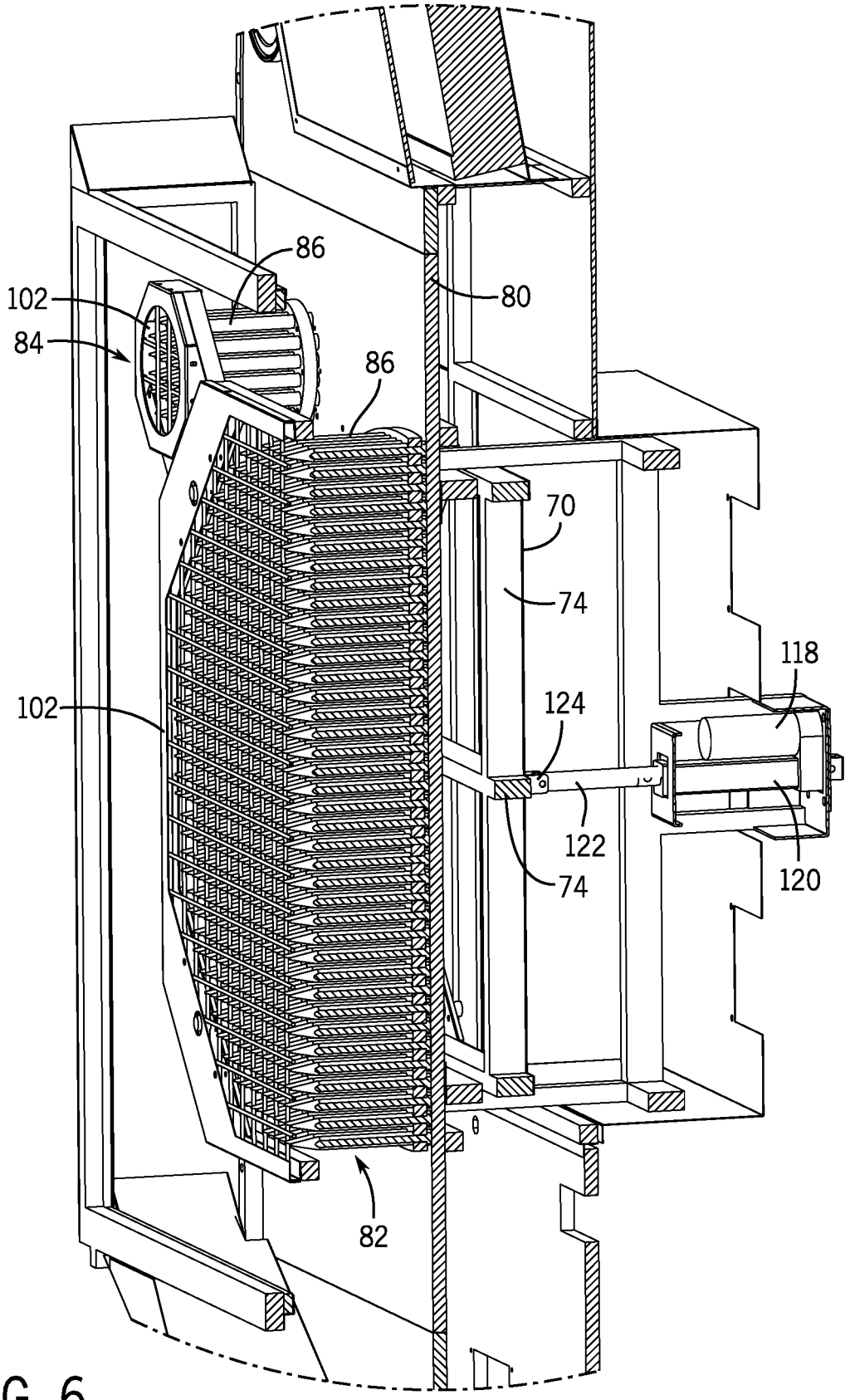
FIG. 6 is a magnified, section view similar to FIG. 5 with the release frame moved to the release position.

FIGS. 5 and 6 illustrate the mounting of a drive motor to the movement frame 70. As illustrated in FIGS. 5 and 6, the drive motor 118 is an electric motor that is coupled to a drive assembly 120. The drive assembly 120 could be a screw drive that when operated by the drive motor 118, extends a threaded extension rod 122. For example, when the drive motor 118 is operated in a first direction, the drive assembly causes the extension rod 122 to move away from the drive motor 118. If the drive motor 118 is operated in the opposite direction, the extension rod 122 is retracted and the outer end moves toward the drive motor 118. Although the drive motor 118 could be operated in two directions, the drive assembly could also include a clutch mechanism to change the direction of movement of the extension rod 122.

The outer end of the extension rod 122 is connected to a bracket 124 located at the intersection of the cross supports 74 of the movement bracket 70. FIG. 5 illustrates the extension rod 122 in a fully retracted position while FIG. 6 illustrates the extension rod 122 in the fully extended position. As was previously discussed, the movement frame 70 includes a plurality of connecting rods 76 positioned at each of the corners of the movement frame 70. The connecting rods 76 each extend through the access openings formed in the target plate 80 and are securely connected to the release frame 96. As can be understood in FIGS. 5 and 6, when the drive motor 118 operates to extend the extension rod 122 into the extended position shown in FIG. 6, the movement of the extension frame moves the entire release frame from the retracted, playing position shown in FIG. 5 to the extended, release position shown in FIG. 6. During this movement, the individual fingers 86 of both the primary target 82 and the secondary target 84 pass through the openings in the wire mesh 102 to permit such movement of the release frame 96.

Figure 7:
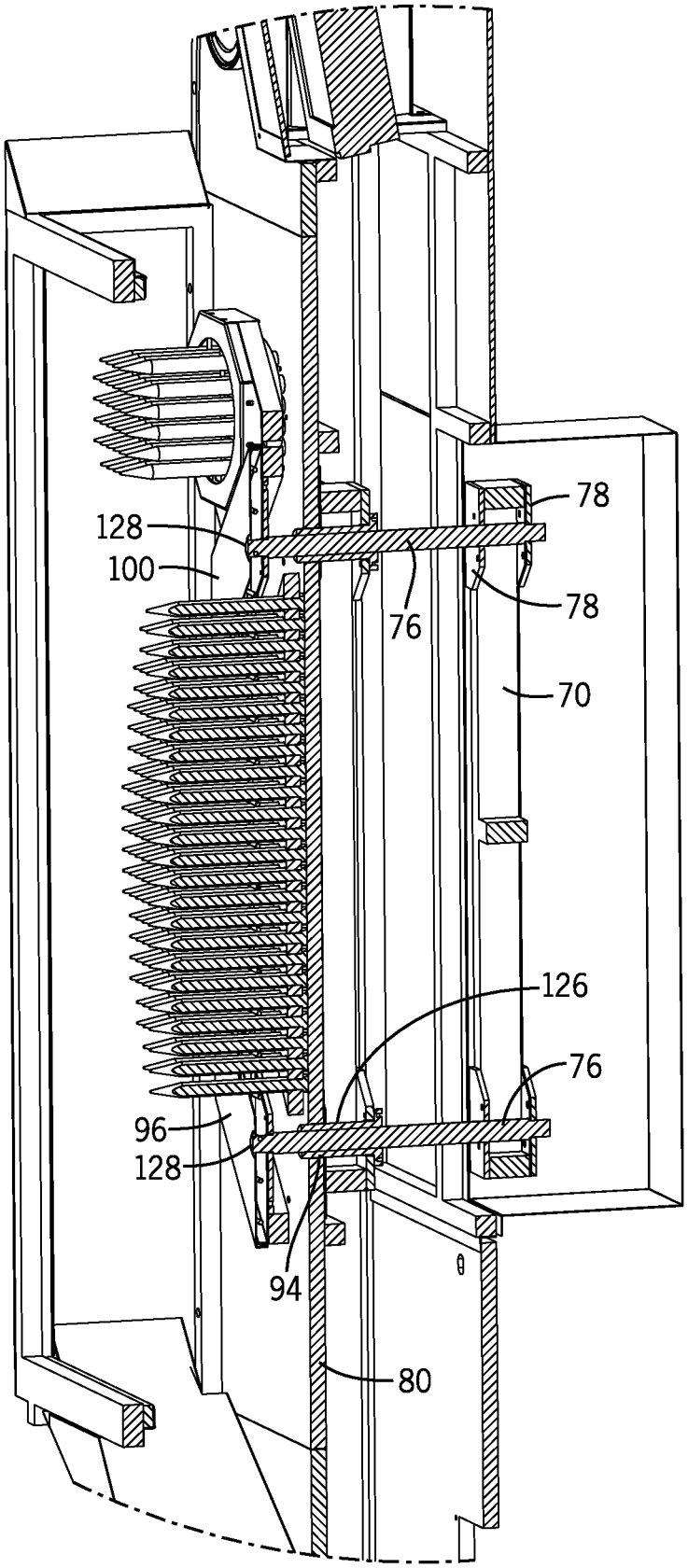
FIG. 7 is a section view taken along line 7-7 of FIG. 5.

FIG. 7 best illustrates the interconnection of the movement frame 70 to the release frame 96 through the series of connecting rods 76. As shown in FIG. 7, each of the connecting rods 76 is secured to the pair of corner plates 78 located at each corner of the movement frame 70. Each connecting rod 76 extends through a nylon bushing 126 that is received within one of the access openings 94 formed in the target plate 80. The nylon bushings 126 allow for smooth movement of the connecting rod 76 during extended operation of the amusement game and reduce wear on the connecting rods 76 and the target plate 80. An outer end 128 of each connecting rod 76 is securely retained within the outer frame 100 of the release frame 96 such that the release frame 96 moves with the movement of the movement frame 70.

Figure 8:
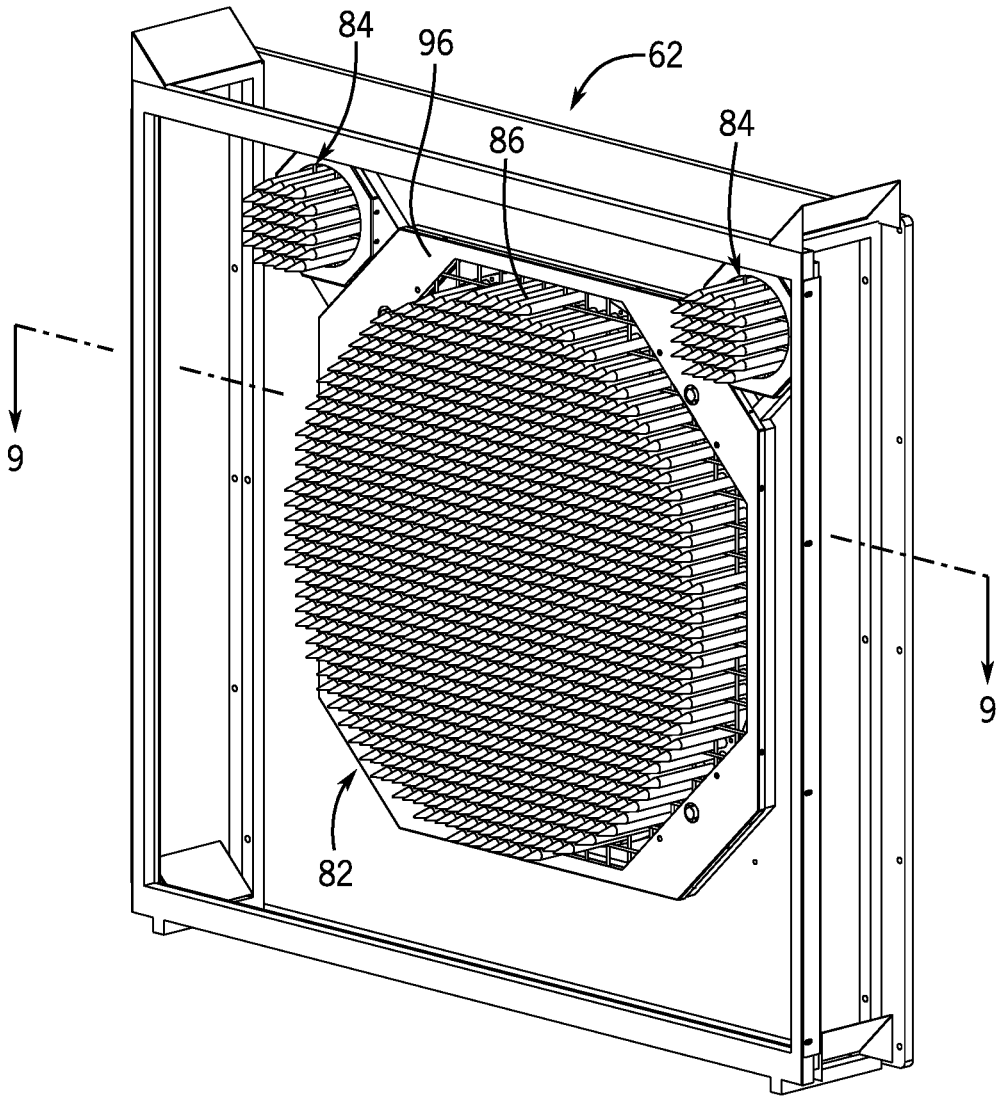
FIG. 8 is a perspective view of the target assembly with the release frame in the retracted, playing position.
Figure 9:
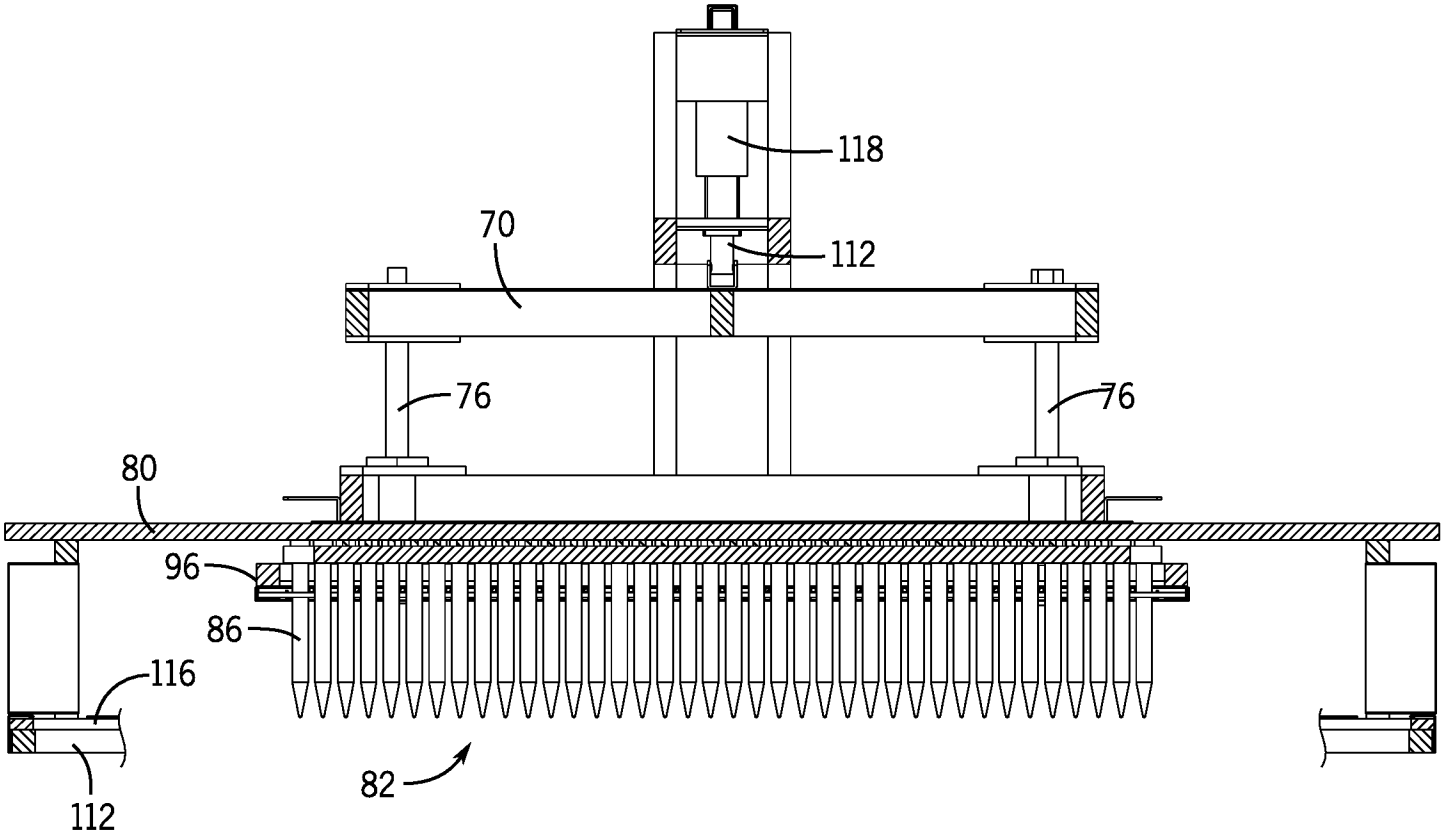
FIG. 9 is a section view taken along line 9-9 of FIG. 8.
Figure 10:
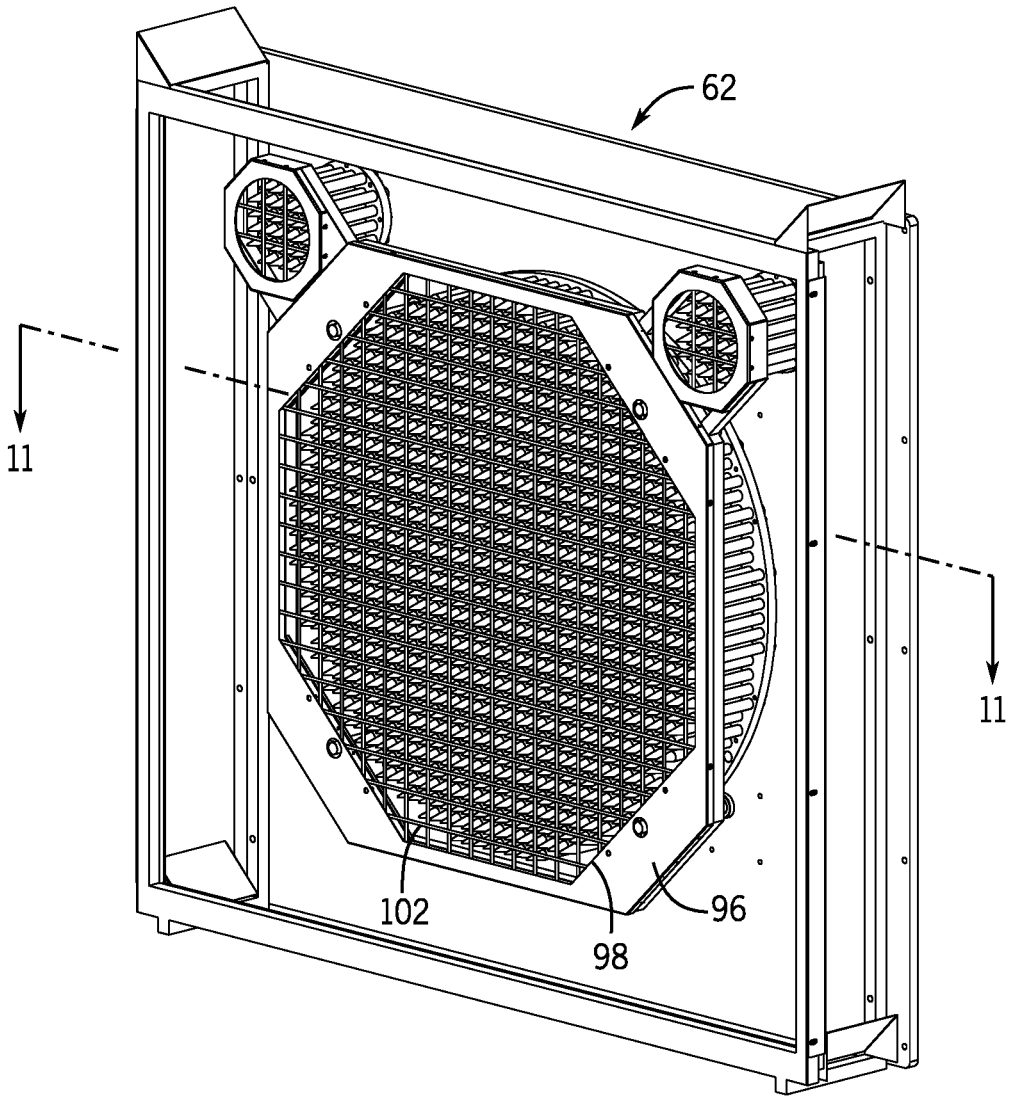
FIG. 10 is a perspective view of the target assembly with the with the release frame moved to the release position.
Figure 11:
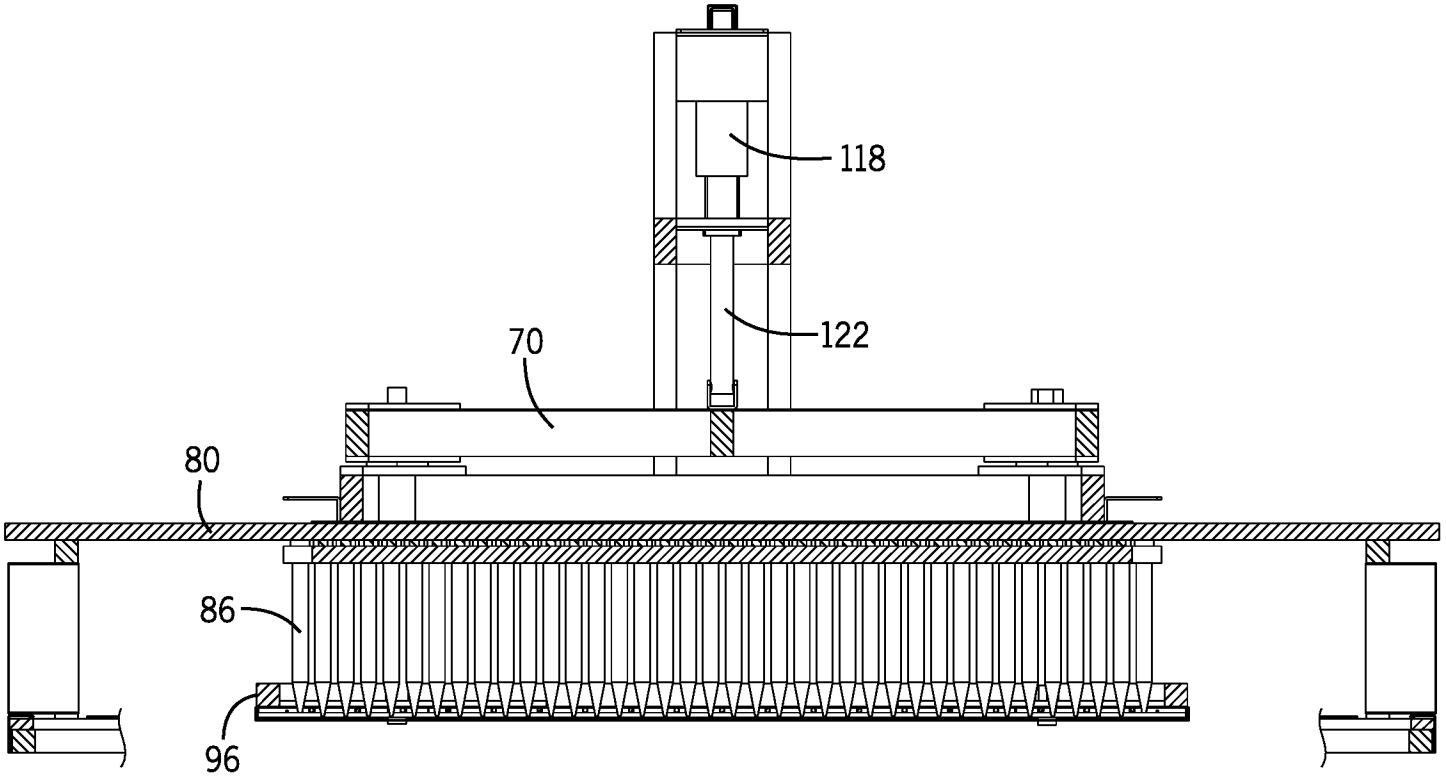
FIG. 11 is a section view taken along line 11-11 of FIG. 10.

FIGS. 8-11 illustrate the operation of the target assembly 62 to move from the retracted, playing position shown in FIGS. 8 and 9 to the extended, release position shown in FIGS. 10 and 11. As shown in FIG. 8, when the target assembly 62 is in the retracted, game playing position, the release frame 96 is fully retracted and the individual fingers 86 in both the primary target 82 and the secondary targets 84 extend through the openings of the wire mesh in the central areas of the release frame 96. In this position, the extension rod 122 is completely retracted and the movement frame 70 is in a retracted position. The connecting rods 76 that extend between the movement frame 70 and the release frame 96 are also in their completely retracted position. In this position, a game piece can be thrown at the primary targets 82 or the secondary targets 84 and can be received and retained between the spaced, individual fingers 86. As indicated previously, FIG. 2 shows one of the game pieces 16 being retained within the primary target. When a game piece is received and retained such as shown in FIG. 2, the light emitters and detectors of the sensor bars 116 mounted to the inner surface of the frame elements 112 are able to detect the position of the game piece and the control unit assigns a score total for the location of the game piece or pieces. It is contemplated that during each round of game play, the player could either throw a single axe or multiple axes at the targets before a score is calculated for the round. Once the game piece or pieces have been scored for the current round, the control unit of the amusement game controls the operation of the drive motor 118 to release the game piece from the target.

To release the game piece, the drive motor 118 shown in FIG. 11 operates to extend the extension rod 122. When the extension rod 122 is extended by operation of the drive motor 118, the entire movement frame 70 is moved away from the drive motor and toward the target plate 80. As the movement frame moves forward, the entire release frame 96 moves forward and the wire mesh 102 located within the center release area 98 moves along the length of each of the plurality of spaced fingers 86. Since the wire mesh 102 includes openings that are much larger than the spacing between the fingers, the movement of the release frame 96 dislodges the game piece 16 that is received and retained by the fingers of the primary or secondary targets. Such movement causes the game piece 16 to fall from either the primary or secondary targets and onto the upper run of the return conveyor 40, as is best illustrated in FIG. 3.

At the same time that the drive motor 118 is operated to move the release frame to its extended, release position, the control unit operates the drive motor of the return conveyor 40 to cause the upper run of the conveyor belt to move in the direction shown by the arrow in FIG. 3. Thus, during the removal process, the control unit of the amusement game both releases the game piece from the target area through operation of the drive motor 118 and also returns the game piece to the player through operation of the drive motor associated with the return conveyor 40. The return conveyor 40 continues to operate until the released game piece falls within the access area 30 shown in FIG. 4. When the game piece is within the access area 30 shown in FIG. 4, the player can retrieve the game piece and again throw the game piece at the target structure.

As can be understood by the previous disclosure, the present disclosure relates to an amusement game that has a function of catching an axe-shaped game piece on one or more targets as the game piece is thrown toward a target area. The amusement game of the present disclosure includes components for scoring and automatically retrieving the axe-shaped game piece to the player for further game play.

The amusement game includes one or more targets that each include a plurality of nylon fingers that extend outward in a spaced relationship that are designed to receive and retain the axe-shaped game piece in a stable and reliable manner. The target assembly further includes an infrared detection frame that is positioned around the outer periphery of the target plate to accurately detect a game piece when the game piece is received on one of the target areas. The detection of the sensor frame thus improves the accuracy of the game results by automatically scoring the location of the game piece relative to the target. The amusement game further includes an axe recovery component that allows the game piece to be automatically retrieved after the game has finished or after a round of the game has finished without the need for manual retrieval. The axe recovery component includes a return conveyor that receives one of the game pieces and returns the game piece to the player.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. An amusement game for play by one or more players, comprising:

at least one game piece;

a stationary target positioned a playing distance from the one or more players, the target including a plurality of spaced fingers extending from a finger plate, wherein the fingers are spaced to receive and retain the at least one game piece when the game piece is thrown by the player into contact with the target;

a release frame including a wire mesh that is positioned between the plurality of spaced fingers, the release frame being movable relative to the target between a retracted playing position and an extended release position such that movement of the release frame from the retracted playing position to the extended release position moves the wire mesh along and between the plurality of spaced fingers to release the at least one game piece from the target; and a return conveyor having a first end positioned beneath the target and a second end positioned near the one or more players, wherein the return conveyor is operable to return the game piece released from the target to the player.

2. The amusement game of claim 1 wherein the target includes a plurality of separate target areas each including the plurality of spaced fingers.

3. The amusement game of claim 2 wherein the plurality of separate target areas includes a center target area and two side target areas, wherein the center target area is larger than the side target areas.

4. The amusement game of claim 1 wherein the release frame is coupled to a drive member operable to move the release frame between the playing position and the release position.

5. The amusement game of claim 4 wherein the drive member includes a drive motor and an extension rod.

6. The amusement game of claim 1 wherein the plurality of spaced fingers are each formed from nylon and are securely attached to the finger plate.

7. The amusement game of claim 6 wherein the finger plate is attached to a fixed target plate and the release frame is supported by a plurality of connecting rods that each extend through the fixed target plate and are movable relative to the fixed target plate.

8. An amusement game for play by one or more players, comprising:

a game piece configured to be thrown by the one or more players;

a stationary target positioned a playing distance from the one or more players, the target including a plurality of spaced fingers extending from a finger plate, wherein the fingers are spaced to receive and retain the game piece when the game piece is thrown by the player into contact with the target;

a release frame including a wire mesh that is positioned between the plurality of spaced fingers, the release frame being movable relative to the target between a retracted playing position and an extended release position, wherein movement of the release frame from the retracted playing position to the extended release position moves the wire mesh along and between the plurality of spaced fingers to release the game piece from the target; and a plurality of sensors positioned to sense the target, wherein the sensors are operable to detect and determine the position of the game piece relative to the target when the game piece is received and retained by the target.

9. The amusement game of claim 8 wherein the plurality of sensors are infrared sensors mounted to a sensor frame positioned to surround the target.

10. The amusement game of claim 8 wherein the release frame is coupled to a drive member operable to move the release frame between the playing position and the release position.

11. The amusement game of claim 10 wherein the finger plate is attached to a fixed target plate and the release frame is supported by a plurality of connecting rods that each extend through the fixed target plate and are movable relative to the fixed target plate.

12. The amusement game of claim 8 further comprising a return conveyor having a first end positioned beneath the target and a second end positioned near the one or more players, wherein the return conveyor is operable to return the game piece released from the target to the player.

13. An amusement game for play by one or more players, comprising:

an axe-shaped game piece configured to be thrown by the one or more players;

a stationary target positioned a playing distance from the one or more players, the target including a plurality of spaced fingers extending from a fixed target plate, the plurality of spaced fingers designed to receive and retain the axe-shaped game piece when the game piece is thrown by the player at the target;

a release frame including a wire mesh that is positioned between the plurality of spaced fingers, the release frame being mounted to a plurality of connecting rods that each extend through the fixed target plate, wherein the release frame and connecting rods are movable relative to the target between a retracted playing position and an extended release position, wherein movement of the release frame from the retracted playing position to the extended release position moves the wire mesh along and between the plurality of spaced fingers to release the axe-shape game piece from the target;

a plurality of sensors positioned to sense the target, wherein the sensors are operable to detect and determine the position of the game piece relative to the target when the game piece is received and retained by the target; and a return conveyor having a first end positioned beneath the target and a second end positioned near the one or more players, wherein the return conveyor is operable to return the axe-shaped game piece released from the target to the player.

14. The amusement game of claim 13 wherein the return conveyor is operated when the release frame is moved to the extended release position.

15. The amusement game of claim 13 wherein the plurality of sensors are infrared sensors mounted to a sensor frame positioned to surround the target.

* * * * *